US006650861B2

(12) United States Patent
Inukai et al.

(10) Patent No.: US 6,650,861 B2
(45) Date of Patent: Nov. 18, 2003

(54) ELECTROPHOTOGRAPHIC IMAGE FORMING APPARATUS

(75) Inventors: Katsumi Inukai, Iwakura (JP); Hideaki Deguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/029,209

(22) Filed: Dec. 28, 2001

(65) Prior Publication Data

US 2003/0103785 A1 Jun. 5, 2003

(30) Foreign Application Priority Data

Dec. 28, 2000 (JP) ..... 2000-400890

(51) Int. Cl.[7] ..... G03G 15/16
(52) U.S. Cl. ..... 399/314; 399/66
(58) Field of Search ..... 399/38, 66, 297, 399/310, 314

(56) References Cited

U.S. PATENT DOCUMENTS 5,450,180 A * 9/1995 Ohzeki et al. ..... 399/314 X
5,822,651 A * 10/1998 Yim et al. ..... 399/66
5,893,661 A * 4/1999 Sakai et al. ..... 399/66
6,266,495 B1 * 7/2001 Yuminamochi et al. ..... 399/66
6,404,998 B1 * 6/2002 Tanaka et al. ..... 399/66

FOREIGN PATENT DOCUMENTS

JP 2-264987 A 10/1990
JP 2-272590 A 11/1990

* cited by examiner

*Primary Examiner*—Hoan Tran
(74) *Attorney, Agent, or Firm*—Oliff & Berridge, PLC

(57) ABSTRACT

A bias applied to a transfer roller is subjected to the constant-current control when the resistances of the transfer roller and a sheet are high. Thereby, a sufficient amount of current is supplied to the sheet and the toner on a photosensitive drum is reliably transferred to the sheet. If the constant-current control is continuously performed after the resistances of the transfer roller and the sheet decrease, the amount of current flowing through the sheet decreases and the toner on the photosensitive drum is not transferred to the sheet. Instead, by controlling the bias applied to the transfer roller such that the transfer current increases when the resistances of the transferring element and the sheet are low, the amount of current flowing through the sheet increases enough to allow the toner transfer from the photosensitive drum to the sheet. By switching the method of controlling the current of the bias applied to the transfer roller depending on whether the resistances of the transfer roller and the sheet are high or low, the toner on the photosensitive drum is reliably transferred to the sheet at all times.

13 Claims, 5 Drawing Sheets

ELECTROPHOTOGRAPHIC IMAGE FORMING APPARATUS

BACKGROUND OF THE INVENTION

1. Field of Invention

The invention relates to an electrophotographic image forming apparatus, such as a laser printer.

2. Description of Related Art

Electrophotographic image forming apparatus are well known in the art. These devices, such as a laser printer, typically includes a photosensitive drum, a charger, a laser scanner, a developing roller, and a transfer roller. After the surface of the photosensitive drum is uniformly charged by the charger, the surface of the photosensitive drum is irradiated with a laser beam emitted from the laser scanner, and an electrostatic latent image is formed based on predetermined image data.

Toner carried on the developing roller is supplied to the electrostatic latent image formed on the surface of the photosensitive drum. The toner deposited on the surface of the photosensitive drum is transferred to a sheet passing between the photosensitive drum and the transfer roller.

Transfer bias is applied to the transfer roller to transfer the toner to the sheet. Either constant-voltage control or constant-current control is employed to control the transfer bias. It is difficult to arrive at a compromise between the constant-voltage control and the constant-current control because both methods have advantages and disadvantages.

SUMMARY OF THE INVENTION

The invention provides an image forming apparatus and method where a transfer bias is applied to a transfer roller without causing a transfer failure of toner to a sheet when the resistances of the transfer roller and the sheet change in accordance with a change in temperature, humidity, and size of the sheet.

When the transfer bias is controlled by the constant-voltage control alone, the current value changes as the resistances of the transfer roller and the sheet change with changes in environmental factors such as temperature and humidity and with changes in type and size of the sheet. For example, when the resistance increases, a shortage of the transfer current occurs, which results in a transfer failure. However, when the transfer bias is controlled by the constant-current control alone, a constant transfer current can be supplied at all times even when the resistances of the transfer roller and the sheet change with changes in environmental factors such as temperature and humidity and changes in the type and size of the sheet. Therefore, it is preferable that the transfer bias is applied to the transfer roller under constant-current control.

If the sheet is substantially as wide as the transfer roller when the transfer bias is applied under constant-current control alone, a constant transfer bias is supplied at all times even when the resistances of the transfer roller and the sheet change. Thus, the sheet can be uniformly charged. However, if the sheet is narrower than the transfer roller, the transfer roller makes, direct contact at both ends with the photosensitive drum without a sheet therebetween. The amount of transfer current flowing directly from the ends of the transfer roller to the photosensitive drum relatively increases, and a shortage of the transfer current occurs, which results in a transfer failure. If the constant-current control is switched to the constant-voltage control when the resistances of the transfer roller and the sheet decrease, a transfer failure can be prevented. However, abrupt switching from the constant-current control to the constant-voltage control would cause a drastic increase in the transfer current amount. In such a case, the surface voltage of the photosensitive drum becomes unstable and the image quality deteriorates. If an excessive amount of transfer current flows to the surface of the photosensitive drum, the photosensitive layer may be damaged.

In recent years, a discharge lamp, which reduces the surface voltage of the photosensitive drum after the toner transfer, has been omitted from many laser printers to simplify their structure and reduce their manufacturing cost. In this case, the surface voltage of the photosensitive drum becomes more unstable. Alternatively, the transfer bias can be changed based on the temperature and humidity detected by a sensor within the laser printer. In this case, however, the laser printer becomes complicated in structure and the manufacturing cost thereof is increased.

According to the invention, an image forming device has a transferring element that transfers toner, forming a visualized image on a photosensitive member, to a recording medium and a transfer bias application device that applies a transfer bias to the transferring element. Under the control of the transfer bias application device, the transfer bias is outputted at a constant current value so that a transfer current required for transferring the toner to a recording medium is obtained. In this case, when the transfer current passing though the recording medium decreases, the constant current value of the transfer bias outputted is set to be higher in order to increase the current passing through the recording medium.

Normally, the transfer bias application device performs the constant-current control where the transfer bias set at a constant current value is applied to the transferring element. Accordingly, even if the resistances of the transferring element and the recording medium change with changes in temperature and humidity within a certain range and with changes in type and size of the recording medium within a certain range, a constant transfer current is supplied to the recording medium at all times to sufficiently charge the recording medium.

When the size of the recording medium is smaller than the width of the transferring element, a relatively large amount of current flows directly from the transferring element to the photosensitive member and a relatively small amount of current flows through the recording medium. When the resistances of the transferring element and the recording medium decrease and particularly when the resistance of the transferring element is lower than that of the recording medium, the amount of current flowing through the recording medium tends to decrease. In this case, the recording medium is not sufficiently charged and, as a result, the toner is not transferred from the photosensitive member to the recording medium. In this state, the transfer bias application device increases the current value of the transfer bias outputted from the transfer bias application device to increase the amount of current flowing through the recording medium.

When the amount of current flowing through the recording medium decreases, the transfer bias application device gradually increases the current value instead of performing constant-current control. When the control method is changed, the transfer current does not increase drastically. Accordingly, fluctuations in the surface voltage of the photosensitive member and a damage to a photosensitive layer are effectively prevented. In addition, because the above-described control is performed without a temperature/humidity sensor, the image forming device can be simplified in structure and the manufacturing cost thereof can be reduced.

When the transfer bias application device gradually increases the current value, the output voltage from the transfer bias application device is kept constant and the amount of transfer current is increased as a linear function with the decrease in the resistance of the recording medium and the transferring element. Under the above-described control, the amount of current can be easily adjusted and the transfer bias can be reliably applied to the recording medium.

The transfer bias application device includes a constant-current control circuit that keeps constant the current value of the transfer bias applied to the transferring element, a variable-current control circuit that changes the current value of the transfer bias applied to the transferring element in response to changes in the resistances of the recording medium and the transferring element, and a transfer bias output circuit that outputs the transfer bias. The transfer bias output circuit is controlled by either the constant-current control circuit or the variable-current control circuit and outputs the transfer bias as controlled.

The constant-current control circuit supplies a predetermined input to the transfer bias output circuit. The predetermined input changes in response to the resistances of the transferring element and the recording medium and is used to output a constant current value from the transfer bias output circuit at all times. In contrast, the variable-current control circuit supplies a constant input to the transfer bias output circuit. The transfer bias control circuit outputs the transfer bias based on the input from the variable current control circuit. The current value of the transfer bias is not constant and varies depending on the total resistance including the resistance of the transferring element and that of the recording medium.

Upon the application of the transfer bias to the transferring element and upon the flow of transfer current to the transferring element, a voltage is generated in the transferring element in response to the transfer current value and the total resistance including the resistance of the transferring element and that of the recording medium. This voltage is defined as a transfer voltage. During the constant-current control, the transfer voltage changes in response to changes in the resistances. When the absolute value of the transfer voltage decreases below a predetermined level with decrease in the resistances, the control by the constant-current control circuit is switched to the control by the variable-current control circuit. The predetermined level is previously determined during the device design phase and is reflected on an input from the variable-current control circuit to the transfer bias output circuit. Which control is employed to control the transfer current is determined by comparison between an input from the constant-current control circuit to the transfer bias application circuit and an input from the variable-current control circuit to the transfer bias application circuit.

These inputs are voltages. When the input voltage from the constant-current control circuit to the transfer bias application circuit is higher, the transfer bias outputted from the transfer bias output circuit is subjected to constant-current control. When the input from the variable-current control circuit to the transfer bias application circuit is higher, the current value of the transfer bias outputted from the transfer bias output circuit is changed. The transfer bias current control method is switched depending on the high-low relationship of the inputs to the transfer bias control circuit. Accordingly, the transfer bias can be reliably controlled with a very simple structure and at a reduced cost.

In addition, a diode is connected between the constant-current control circuit and the transfer bias application circuit, and another diode is connected between the variable-current control circuit and the transfer bias application circuit. Thus, when the output voltage from the constant-current control circuit becomes higher than the output voltage from the variable-current control circuit, no current flows from the constant-current control circuit to the variable-current control circuit. When the output voltage from the variable-current control circuit becomes higher than the output voltage from the constant-current control circuit, no current flows from the variable-current control circuit to the constant-current control circuit, either. As the transferring element, it is preferable to use a transfer roller and more preferable to use an ionic conduction type transfer roller.

Toner is transferred to the recording medium by contacting the recording medium to the transfer roller and by applying a voltage of the opposite polarity to that of the toner to the transfer roller. Because the transfer roller makes contact with the recording medium, the recording medium itself is charged to a lesser extent and easily removed from the transfer roller. An ionic conduction type transfer roller is advantageous in that its resistance is uniform and varies slightly, but disadvantageous in that its resistance varies greatly with environmental factors such as temperature and humidity. According to the invention, a current required for the toner transfer is reliably obtained even when the resistance of the transfer roller varies.

The constant current value of the transfer bias, which is controlled by the constant-current control circuit and outputted from the transfer bias, can be made selectable depending on the size of the recording medium. This prevents a shortage of the transfer current caused by variations in size and ensures a sufficient supply of the transfer current to the recording medium of any size.

When the recording medium is small in size, the amount of current flowing directly from the transferring element to the photosensitive member increases and the amount of current flowing through the recording medium decreases. For this reason, when the recording medium is small, the current value of the transfer bias outputted from the transfer bias output circuit is controlled to be at a higher value. Thereby, the recording medium can be sufficiently charged and the toner can be reliably transferred to the recording medium.

Particularly, operability of the image forming device is improved if it is structured to detect the size of the recording medium and change the current value by the detected size.

While this invention has been described in conjunction with specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of the invention.

BRIEF DESCRIPTION OF THE DRAWINGS

The invention will be described with reference to the accompanying drawings, in which line elements are labeled with like numbers and in which.

DETAILED DESCRIPTION OF PREFERRED EMBODIMENTS

Figure 1:
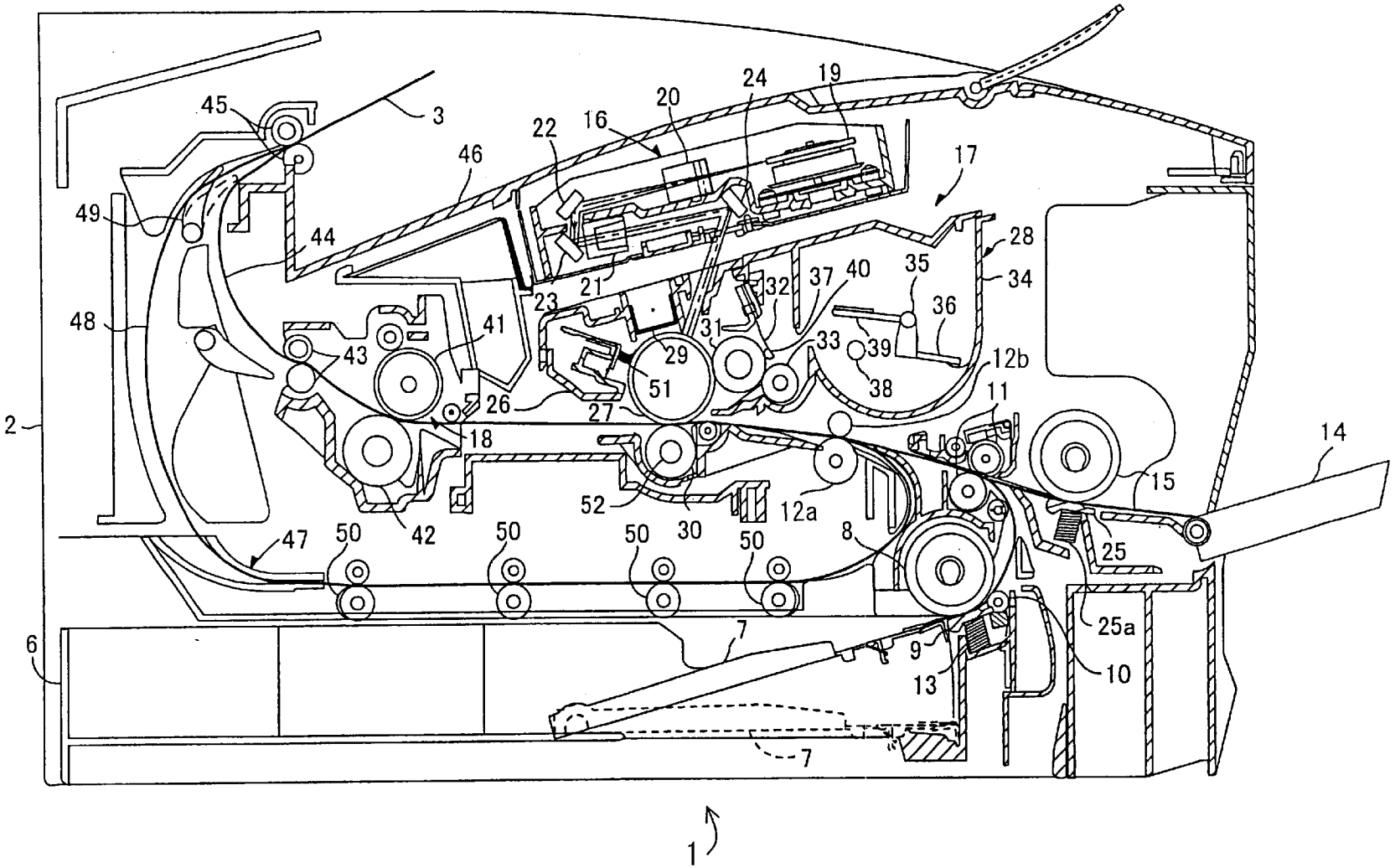
FIG. 1 is a side sectional view of the substantial parts of a laser printer according to one embodiment of this invention.

FIG. 1 is a side sectional view of the substantial parts of a laser printer 1. A sheet feed tray 6 is detachably attached to a bottom portion of a casing 2. A presser plate 7 is provided in the sheet feed tray 6 so as to support and upwardly press sheets 3 stacked in the sheet feed tray 6. A pickup roller 8 and a separation pad 9 are provided above one end of the sheet feed tray 6, and register rollers 12*a*, 12*b* are provided downstream from the pickup roller 8 with respect to the sheet conveying direction.

The presser plate 7 allows sheets 3 to be stacked thereon. The presser plate 7 is pivotally supported at its end remote from the sheet feed roller 8 such that the presser plate 7 is vertically movable at its end closer to the sheet feed roller 8. The presser plate 7 is urged upwardly from its reverse side by a spring (not shown). When the stack of sheets 3 is increased in quantity, the presser plate 7 swings downwardly about the end of the presser plate 7 remote from the sheet feed roller 8, against the urging force from the spring. The sheet feed roller 8 and the sheet feed pad 9 are disposed facing each other. The sheet feed pad 9 is urged toward the sheet feed roller 8 by a spring 13 disposed on the reverse side of the sheet feed pad 9.

An uppermost sheet 3 in the stack on the presser plate 7 is pressed against the sheet feed roller 8 by the spring provided on the reverse side of the presser plate 7, and the uppermost sheet 3 is pinched between the sheet feed roller 8 and the sheet feed pad 9 when the sheet feed roller 8 rotates. Thus, print sheets 3 are fed one by one from the top.

After paper dust is removed from the sheet 3 by a paper dust removing roller 10, the sheet 3 is conveyed by conveyer rollers 11 to the resister rollers 12*a* and 12*b*. The register rollers 12*a* and 12*b* are made up of two rollers, that is, a driving roller 12*a* provided for the casing 2 and a driven roller 12*b* provided for a process unit 17, which will be described later. The driving roller 12*a* and the driven roller 12*b* make a surface-to-surface contact with each other. The sheet 3 conveyed by the conveyor rollers 11 is further conveyed downstream while being pinched between the driving roller 12*a* and the driven roller 12*b*.

The driving roller 12*a* is not driven before the sheet 3 makes contact with the driving roller 12*a*. After the sheet 3 makes contact with the driving roller 12*a* and the driving roller 12*a* corrects the orientation of the sheet 3, the driving roller 12*a* rotates and conveys the sheet 3 downstream.

A manual feed tray 14 from which sheets 3 are manually fed and a manual feed roller 15 that feeds sheets 3 staked on the manual feed tray 14 are provided at the front of the casing 2. A separation pad 25 is disposed facing the manual feed roller 15. The separation pad 25 is urged toward the manual feed roller 15 by a spring 25*a* disposed on the reverse side of the separation pad 9. The sheets 3 stacked on the manual feed plate 14 are fed one by one while being pinched by the manual feed roller 15 and the separation pad 15 when the manual feed roller 15 rotates.

The casing 2 further includes a scanner unit 16, a process unit 17, and a fixing unit 18. The scanner unit 16 is provided in an upper portion of the casing 2 and has a laser emitting portion (not shown), a rotatable polygonal mirror 19, lenses 20 and 21, and reflecting mirrors 22, 23 and 24. A laser beam emitted from the laser emitting portion is modulated based on predetermined image data. The laser beam sequentially passes through or reflects from the optical elements, that is, the polygonal mirror 19, the lens 20, the reflecting mirrors 22, 23, the lens 21, and the reflecting mirror 24 in the order indicated by a broken line in FIG. 1. The laser beam is thus directed to and high-speed scanned at high speed over the surface of a photosensitive drum 27, which will be described later.

Figure 2:
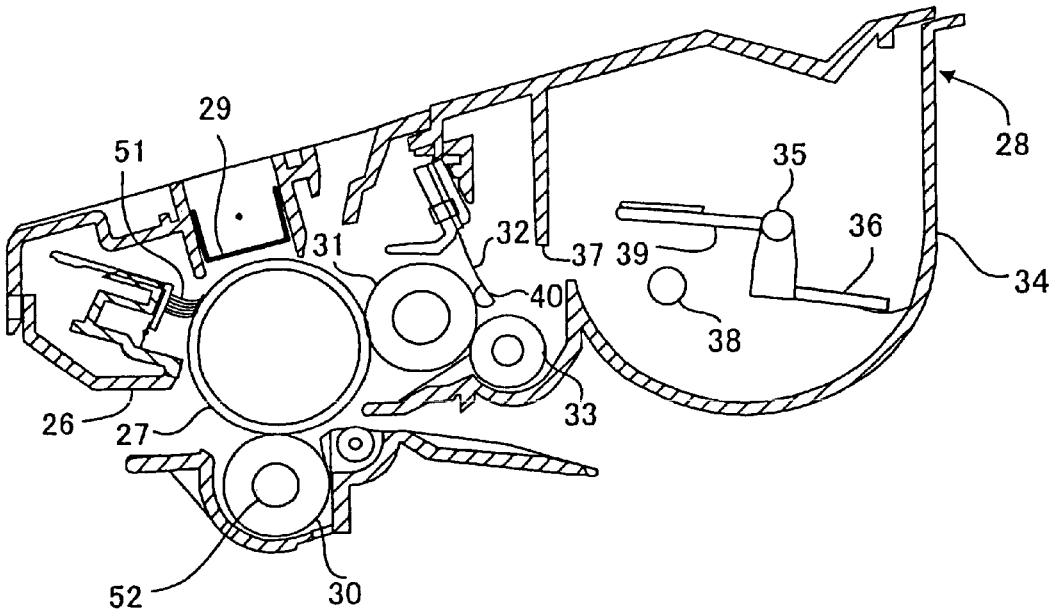
FIG. 2 is a side sectional view of the substantial parts of a process unit of the laser printer.

FIG. 2 is an enlarged sectional view of the process unit 17. As shown in FIG. 2, the process unit 17 is disposed below the scanner unit 16 and has a drum cartridge 26 detachably attached to the casing 2 and a developing cartridge 28 detachably attached to the drum cartridge 26. The drum cartridge 26 includes the photosensitive drum 27, a scorotron charger 29, a transfer roller 30, and an electrically conductive brush 51. The developing cartridge 28 includes a developing roller 31, a blade 32, a supply roller 33, and a toner box 34.

The toner box 34 contains positively charged nonmagnetic single-component toner, as a developing agent. The toner used in this embodiment is a polymerized toner obtained through copolymerization of styrene-based monomers, such as styrene, and acryl-based monomers, such as acrylic acid, alkyl (C1–C4) acrylate, alkyl (C1–C4) methacrylate, using a known polymerization method, such as suspension polymerization. The particle shape of such a polymerized toner is spherical, and thus the polymerized toner has excellent flowability.

A coloring agent, such as carbon black, and wax is added to the polymerized toner. An external additive, such as silica, is also added to the polymerized toner to improve flowability. The particle size of the polymerized toner is approximately 6–10 $\mu$m.

The toner in the toner box 34 is stirred by an agitator 36 supported by a rotating shaft 35 provided at a central portion of the toner box 34, and is discharged from a toner supply port 37 opened on one side of the toner box 34. A toner detection window 38 is provided on a sidewall of the toner box 34. The toner detection window 38 is wiped clean by a cleaner 39 supported by the rotating shaft 35.

A supply roller 33 is rotatably disposed adjacent to the toner supply port 37. A developing roller 31 is rotatably disposed facing the supply roller 33. The supply roller 33 is formed by covering a metallic roller shaft with an electrically conductive foam material. The developing roller 31 is formed by covering a metallic roller shaft with an electrically conductive rubber material. More specifically, the developing roller 31 is covered with an electrically conductive urethane or silicone rubber containing fine carbon particles, and topcoated with a urethane or silicone rubber containing fluorine. The supply roller 33 and the developing roller 31 are disposed in contact with each other so that they are press-deformed against each other to an appropriate extent. A predetermined developing bias is applied to the developing roller 31 with respect to the photosensitive drum 27.

A layer thickness-regulating blade 32 is disposed near the developing roller 31 to regulate the thickness of a toner layer formed on the surface of the developing roller 31. The layer thickness-regulating blade 32 has a metallic plate spring and a presser portion 40, which is disposed on a distal end of the plate spring and formed from an electrically insulative silicone rubber into a semicircular shape in section. The plate spring is supported, at its end opposite to its distal end, by a developing cartridge 28 so as to be close to the developing roller 31. The presser portion 40 is pressed against the developing roller 31 by an elastic force of the plate spring.

Toner discharged by the agitator 36 from the toner supply port 37 is supplied to the developing roller 31 when the supply roller 33 rotates. Toner is positively charged between the supply roller 33 and the developing roller 31 due to friction. After passing between the presser portion 40 and the developing roller 31, toner is formed into a thin layer of a predetermined thickness on the developing roller 31.

The photosensitive drum 27 is rotatably disposed adjacent to a drum cartridge 26 so as to be in contact with the developing roller 31. The photosensitive drum 27 is formed by coating a grounded cylindrical aluminum drum with a positively charged photosensitive layer made of polycarbonate.

The charger 29 is disposed at a predetermined interval upward from the photosensitive drum 27. The charger 29 is a scorotron charger that produces corona discharge from a tungsten wire and positively charges the surface of the photosensitive drum 27 uniformly. The charger 29 is designed to charge the surface of the photosensitive drum 27 to a voltage of approximately 900 V.

The transfer roller 30 is disposed below the photosensitive drum 27 and is rotatably supported by the drum cartridge 26 so as to face the photosensitive drum 27. The transfer roller 30 is of the ionic conduction type and formed by covering a metallic roller shaft 52 with an elastic member containing an ionic material, such as lithium perchlorate. The resistance of the transfer roller 30 is approximately $10^7$–$10^{8.5}$ Ω at 22° C. and at 50% RH.

Figure 7:
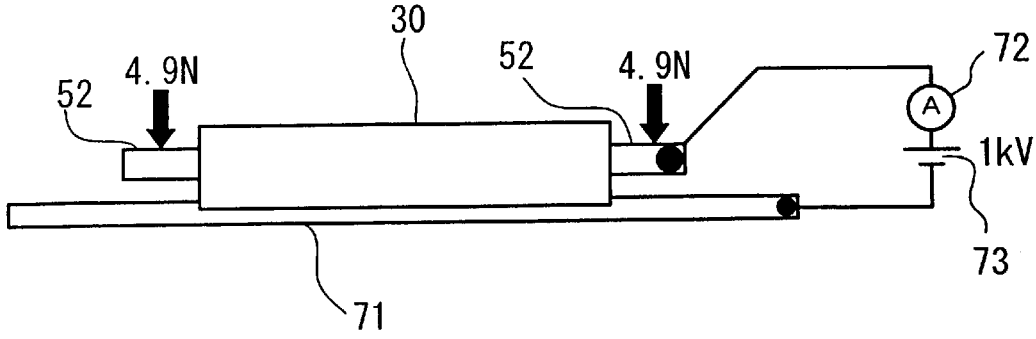
FIG. 7 is a diagram showing a structure for measuring the resistance of a transfer roller.

Referring now to FIG. 7, the method of measuring the resistance of the transfer roller 30 will be described. The transfer roller 30 is placed on a metallic plate 71 and a pressure force of 4.9 N is applied to both ends of the roller shaft 52. This state is substantially equivalent to the state where the transfer roller 30 is pressed by the photosensitive drum 27. By applying a voltage of 1 kV between the roller shaft 52 and the plate 71 from the direct-current power source 73 and by measuring a current detected by an amp meter, the resistance of the transfer roller 30 can be obtained.

A predetermined negative transfer bias is applied to the roller shaft 52 of the transfer roller 30 by a transfer bias application circuit 53, which will be described later. The sheet 3 passing between the photosensitive drum 27 and the transfer roller 30 is charged by the predetermined transfer bias. While the sheet 3 is passing therebetween, the toner carried on the surface of the photosensitive drum 27 is transferred to the sheet 3 by a Coulomb force generated due to a voltage difference between the voltage of the photosensitive drum 27 and the voltage of the sheet 3.

The conductive brush 51 is disposed downstream from the transfer roller 30 and upstream from the scorotron charger 29 with respect to the rotation direction of the photosensitive drum 27 so as to make contact with the surface of the photosensitive drum 27. The conductive brush 51 removes paper dust deposited on the photosensitive drum 27 after the toner transfer to the sheet 3.

As shown in FIG. 1, the fixing unit 18 is disposed downstream from the process unit 17 and has a heat roller 41, a pressure roller 42 pressed against the heat roller 41, and a pair of conveying rollers 43 provided downstream from the heat roller 41 and the pressure roller 42. The heat roller 41 is formed by an aluminum tube coated with a silicone rubber and a halogen lamp placed in the tube. Heat generated from the halogen lamp is transferred to the sheet 3 through the aluminum tube. The pressure roller 42 is made of a silicone rubber, which allows the sheet 3 to be easily removed from the heat roller 41 and the pressure roller 42.

The toner transferred to the sheet 3 by the process unit 17 melts and becomes fixed onto the sheet 3 due to heat, while the sheet 3 is passing between the heat roller 42 and the pressure roller 41. After the fixation is completed, the sheet 3 is conveyed downstream by the conveying rollers 43. An ejecting path 44 is formed downstream from the conveying rollers 43 to reverse the sheet conveying direction and guide the sheet 3 to an output tray 46 provided on the top surface of the laser printer 1. A pair of ejecting rollers 45 are provided at the upper end of the ejecting path 44 to eject the sheet 3 to the output tray 46.

The laser printer 1 is provided with a reverse conveying unit 47 that allows image forming on the both sides of the sheet 3. The reverse conveying unit 47 includes ejecting rollers 45, a reverse conveying path 48, a flapper 49, and a plurality of pairs of reverse conveying rollers 50. A pair of ejecting rollers 45 can be switched between forward and reverse rotation. The ejecting rollers 45 rotate forward to eject the sheet 3 to the output tray 6, and rotate in reverse to reverse the sheet conveying direction.

The reverse conveying path 48 is vertically provided to guide the sheet 3 from the ejecting rollers 45 to the reverse conveying rollers 50 disposed above the sheet feed tray 6. The upstream end of the reverse conveying path 48 is located near the ejecting rollers 45, and the downstream end of the reverse conveying path 48 is located near the reverse conveying rollers 50.

The flapper 49 is swingably provided adjacent to a point branching into the ejecting path 44 and the reverse conveying path 48. The flapper 49 can be shifted between a first position shown by a solid line and a second position shown by a broken line. The flapper 49 is shifted by switching the excited state of a solenoid (not shown).

When the flapper 49 is at the first position, the sheet 3 guided along the ejecting path 44 is ejected by the ejecting rollers 45 to the output tray 46. When the flapper 49 is at the second position, the sheet 3 is conveyed to the reverse conveying path 48 by the ejecting rollers 45 rotating in reverse.

A plurality of pairs of reverse conveying rollers 50 are provided above the sheet feed tray 6 in a horizontal direction. A pair of reverse conveying rollers 50 on the most upstream side are located near the lower end of the reverse conveying path 48. A pair of reverse conveying rollers 50 on the most downstream side are located below the register rollers 12*a* and 12*b*.

The operation of the reverse conveying unit 47 when an image is formed on the both sides of the sheet 3 will be described. The sheet 3 with a printed image on one side thereof is conveyed by the conveying rollers 43 along the ejecting path 44 toward the ejecting rollers 45. At this time, the flapper 49 is located at the first position. The ejecting rollers 45 rotate forward while pinching the sheet 3 to convey the sheet 3 temporarily toward the output tray 4. The ejecting rollers 45 stop rotating forward when the sheet 3 is almost ejected to the output tray 46 and the trailing edge of the sheet 3 is pinched by the ejecting rollers 45. In this state, the flapper 49 is shifted to the second position, and the ejecting rollers 45 rotates in reverse. The sheet 3 is conveyed in the reverse direction along the reverse conveying path 48. After the entire sheet 3 is conveyed to the reverse conveying path 48, the flapper 49 is shifted to the first position.

After the above actions have occurred, the sheet 3 is conveyed to the reverse conveying rollers 50, and conveyed upward by the reverse conveying rollers 50 to the register rollers 12*a* and 12*b*. The sheet 3 is then conveyed to the process unit 17 with its printed side facing down. As a result, an image is printed on both sides of the sheet 3.

The image forming operation will now be described. The surface of the photosensitive drum 27 is uniformly positively charged by the charger 29. The surface voltage of the photosensitive drum 27 is approximately 900 V. When the surface of the photosensitive drum 27 is irradiated with a laser beam emitted from the scanner unit 16, electric charge is removed from a portion exposed to the laser beam, and the surface voltage of the exposed portion becomes approximately 200 V. In this way, the surface of the photosensitive drum 27 is divided into a high-voltage portion (unexposed portion) and a low-voltage portion (exposed portion), and thereby an electrostatic latent image is formed.

When positively charged toner on the developing roller 31 faces the photosensitive drum 27, the toner is supplied to the low-voltage exposed portion of the photosensitive drum 27. As a result, an electric latent image formed on the photosensitive drum 27 is visualized.

The developing roller 31 reclaims the toner remaining on the surface of the photosensitive drum 27. The remaining toner is the toner that has been supplied to the photosensitive drum 27 but not transferred from the photosensitive drum 27 to the sheet 3. The remaining toner adheres to the developing roller 31 by a Coulomb force generated due to a voltage difference between the photosensitive drum 27 and the developing roller 31, and is reclaimed into the developing cartridge 28. With this method, a scraper that scrapes the remaining toner from the photosensitive drum 27 and a storage place for the scraped toner are not required. Thus, a laser printer can be simplified in structure and made compact, and the manufacturing cost thereof can be reduced.

While the sheet 3 is passing between the photosensitive drum 27 and the transfer roller 30, the sheet 3 is charged with a transfer bias. The toner in the form of a visualized image on the photosensitive drum 27 is transferred to the sheet 3 by the action of a Coulomb force.

Figure 3:
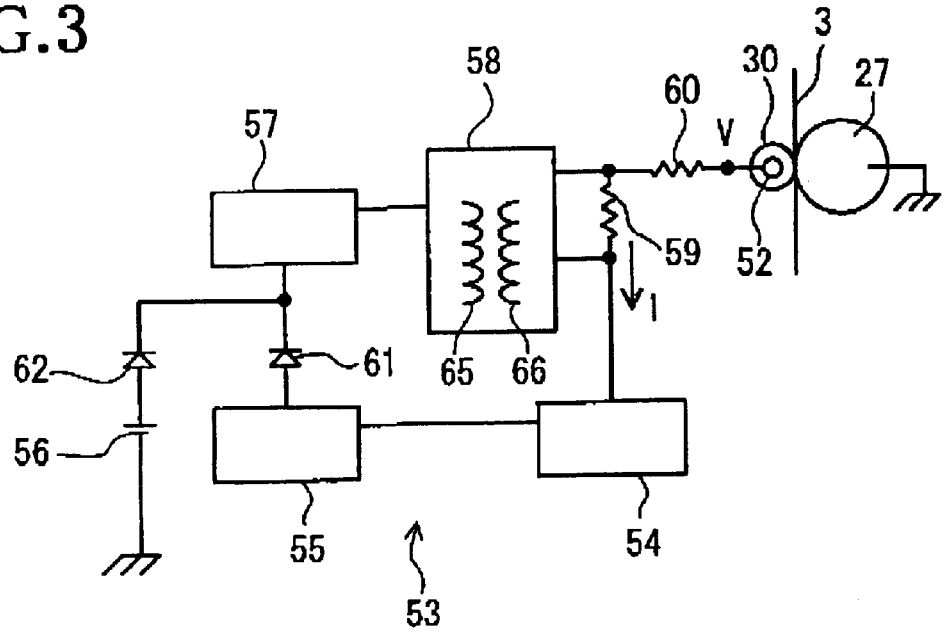
FIG. 3 is a diagram of a transfer bias application circuit of the laser printer.

The transfer bias application circuit 53 is connected to the roller shaft 52 of the transfer roller 30. The transfer bias application circuit 53 is provided within the casing 2 and, as shown in FIG. 3, includes an output current detection circuit 54, a constant-current control circuit 55, a constant-voltage source 56, a booster drive circuit 57, a booster circuit (transformer) 58 having a primary winding 65 and a secondary winding 66, resistors 59 and 60, and diodes 61 and 62.

The constant-current control circuit 55, diode 61, booster drive circuit 57 and the booster circuit 58 are connected, in order, to the downstream side of the output current detection circuit 54. The resistor 59 that stabilizes the output voltage of the booster circuit 58 is connected in parallel to the downstream (output) side of the booster circuit 58. The roller shaft 52 is also connected, via the resistor 60, to the downstream side of the booster circuit 58. In addition, the output current detection circuit 54 is connected to the resistor 59. The surface of the transfer roller 30 makes contact with the photosensitive layer of the photosensitive drum 27. As described above, the cylindrical aluminum drum having the photosensitive layer on its surface is grounded. The constant-voltage source 56 is connected, via the diode 62, to the upstream side of the booster drive circuit 57. The constant-voltage source 56 is grounded.

The operation of the transfer bias application circuit 53 will be described. In the following description, an increase or decrease in the current value and in the voltage refers to an increase or decrease in the absolute value of the current value and in the absolute value of the voltage. When a sheet larger than a certain size is used in the laser printer 1 at room temperature, the resistances of the transfer roller 30 and the sheet 3 are high. At this time, if the absolute value of the voltage of a transfer bias applied to the transfer roller 30 is low, the amount of transfer current decreases and the sheet 3 is insufficiently charged. As a result, the toner is not transferred from the photosensitive drum 27 to the sheet 3. Therefore, a sufficient amount of transfer bias current should be applied to the transfer roller 30 in order to improve the transfer efficiency of the toner to the sheet 3.

The current value of the transfer bias (transfer current) applied to the transfer roller 30 is detected by the output current detection circuit 54. The constant-current control circuit 55 controls the booster drive circuit 50, based on the detected current value, such that a current outputted from the output of the booster circuit 58 is kept at a constant value. Such a constant current value should be adequate for charging the sheet 3 and transferring the toner from the photosensitive drum 27 to the sheet 3.

An output from the booster circuit 58 can be changed by controlling an input to the booster drive circuit 57. The booster circuit 58 boosts an input to the booster circuit 58 between the primary and secondary windings 65 and 66 and produces an output such that the current value detected by the constant-current detection circuit 54 becomes a predetermined value. Accordingly, the transfer bias kept at a constant current value is applied to the roller shaft 52 of the transfer roller 30 at all times.

Even if the resistances of the transfer roller 30 and the sheet 3 decrease when the laser printer 1 is used in a hot and humid environment, or when the type of sheet 3 is changed or the size of sheet 3 is reduced, the sheet 3 can be sufficiently charged by the constant-current control. However, if the resistance of the transfer roller 30 becomes lower than the resistance of the sheet 3, a current flows directly from the transfer roller 30 to the photosensitive drum 27 without passing through the sheet 3. Thus, the amount of current passing through the sheet 3 decreases and the sheet 3 is not sufficiently charged. As a result, the toner is not transferred from the photosensitive drum 27 to the sheet 3.

If the absolute value of the voltage of the roller shaft 52 (transfer voltage) decreases below a certain value, the output voltage from the constant-voltage source 56 exceeds the output voltage from the constant-current control circuit 55. The output of the constant-current control circuit 55 and the output of the constant-voltage source 56 are connected to the input of the booster drive circuit 57, while the diode 61 is connected to the output of the constant-current control circuit 55 and the diode 62 is connected to the output of the constant-voltage source 56. Thus, either the output voltage from the constant-current control circuit 55 or the output voltage from the constant-voltage source 56, whichever is higher, is inputted to the booster drive circuit 57.

Therefore, when the output voltage from the constant-voltage source 56 exceeds the output voltage from the constant-current control circuit 55, the booster drive circuit 57 controls the booster circuit 58 in response to the output voltage from the constant-voltage source 56. An output from the booster voltage circuit 58 is applied to the roller shaft 52 without being subjected to the constant-current control. As the resistances of the transfer roller 30 and the sheet 3 decrease, the absolute value of the voltage of the transfer bias decreases and the absolute value of the current value of the transfer bias increases. The change rate of the current value of the transfer bias has been previously set by the resistors 59 and 60.

Figure 4:
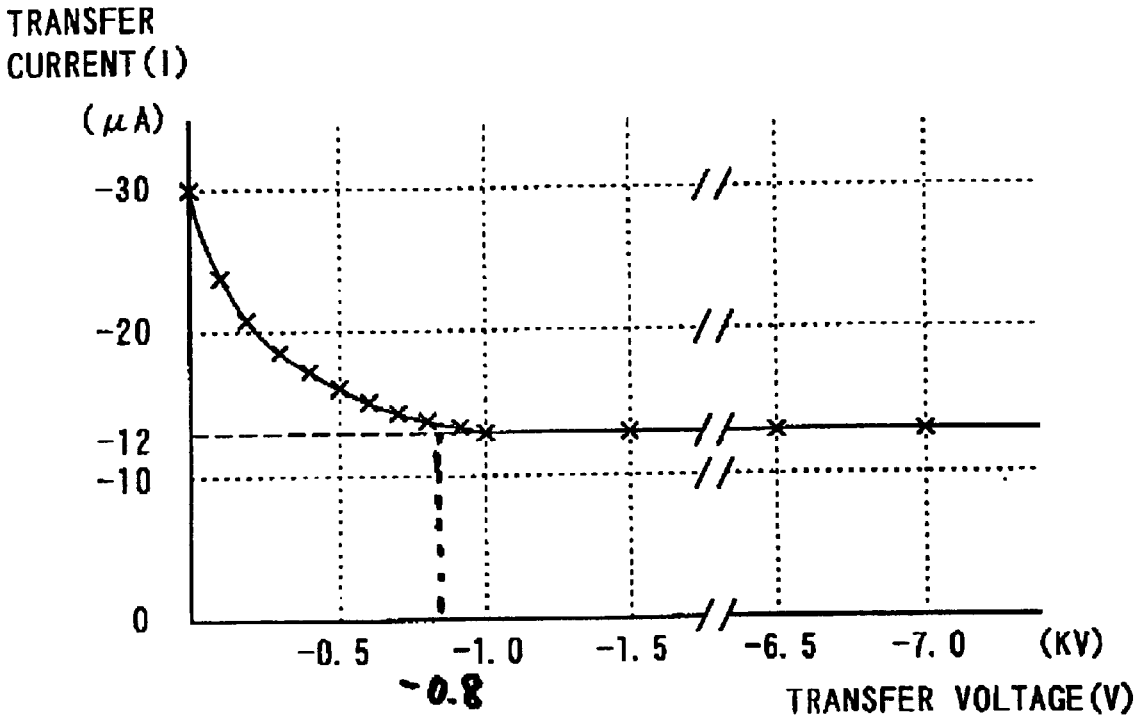
FIG. 4 is a graph showing the voltage-current relationship of a transfer bias applied by the transfer bias application circuit of FIG. 3.

FIG. 4 shows the voltage-current relationship of the transfer bias. The voltage of the transfer bias (transfer voltage in FIG. 4) indicates the voltage of the roller shaft 52 and changes with the resistances of the transfer roller 30 and the sheet 3 during the constant-current control. A current (transfer current in FIG. 4) of −12 $\mu$A is constantly supplied to the roller shaft 52. With this current value, a voltage difference great enough to transfer the toner to the sheet 3 is obtained between the sheet 3 and the photosensitive drum 27. Because the current value is constant, the absolute value of the voltage of the roller shaft 52 increases if the resistances of the transfer roller 30 and the sheet 3 are high.

If a constant-current control to −12 $\mu$A is performed even after the resistances of the transfer roller 30 and the sheet 3 decrease, the absolute value of the voltage of the roller shaft 52 will continue to decrease gradually. When the absolute value of the voltage of the roller shaft 52 decreases below approximately 800 V, the resistance of the transfer roller 30 is lower than the resistance of the sheet 3. In this case, the amount of the current passing through the sheet 3 decreases and thus the sheet 3 is not sufficiently charged. As a result, the toner transfer efficiency is reduced, causing a deterioration in image quality.

The output voltage from the constant-voltage source 56 is set such that the voltage of the roller shaft 52 (transfer voltage) becomes approximately −800 V when the booster drive circuit 57 is controlled based on the output voltage from the constant-voltage source 56. When the absolute value of the transfer voltage decreases below 800 V, the output voltage from the constant-voltage source 56 exceeds the output voltage from the constant-current control circuit 55. Thus, the output voltage from the constant-voltage source 56 is inputted to the booster drive circuit 57.

As the resistances of the transfer roller 30 and the sheet 3 further decrease, the absolute value of the voltage of the transfer bias decreases and the absolute value of the current value of the transfer bias increases according to a curve. The characteristics of this curve can be changed based on the resistances of the resistors 59 and 60.

When the ambient temperature is room temperature and the size of the sheet 3 substantially equals the width of the transfer roller 30, the resistances of the transfer roller 30 and the sheet 3 are high, and thus most of the transfer current passes through the sheet 3 and only a small amount of current leaks. Under such conditions, constant-current control is performed by the constant-current control circuit 55, as described above, in order to keep the transfer bias current applied to the transfer roller 30 at a required value for good toner transfer. Accordingly, even if the resistances of the transfer roller 30 and the sheet 3 change with changes in temperature and humidity within a certain range and with changes in type and size of the sheet 3 within a certain range, a constant transfer current is supplied to the sheet 3 at all times to sufficiently charge the sheet 3. The toner on the surface of the photosensitive drum 27 can be transferred to the sheet 3 by the action of a Coulomb force. Particularly, because the resistance of the transfer roller 30 is variable with changes in temperature and humidity, the above-described constant-current control ensures sufficient charging of the sheet 3 and good toner transfer. The resistances of the transfer roller 30 and the sheet 3 decrease under high temperature and high humidity conditions. If the constant-current control is performed in this state, as described above, the absolute value of the voltage of the transfer bias decreases.

When the size of the sheet 3 is reduced, the resistance of the sheet 3 decreases and the area where the photosensitive drum 27 makes direct contact with the transfer roller 30 increases. If the constant-current control is performed in this state, the amount of current flowing to the portion of the transfer roller 30 out of contact with the sheet 3 relatively increases while the amount of current passing through the sheet 3 relatively decreases. When the amount of current passing through the sheet 3 decreases, the sheet 3 is not sufficiently charged and a Coulomb force acting on the toner is reduced. As a result, the transfer efficiency is reduced, causing a deterioration in image quality.

If constant-current control is performed when the total resistance including the resistance of the transfer roller 30 and that of the sheet 3 is low, the absolute value of the voltage of the roller shaft 52 (transfer voltage) decreases. According to one embodiment, when the absolute value decreases below 800 V, a constant voltage outputted from the constant-voltage source 56 is inputted to the booster drive circuit 57. In this state, if the resistances of the transfer roller 30 and the sheet 3 further decrease, the absolute value of the voltage of the transfer bias applied to the transfer roller 30 decreases, and the absolute value of the transfer current increases according to a curve. Because the amount of the current passing through the sheet 3 increases, the transfer current is sufficiently supplied to charge the sheet 3, and the toner on the photosensitive drum 27 can be effectively transferred to the sheet 3.

Because the rate of gradual increase in the transfer current amount along with the decrease in the absolute value of the transfer voltage is set based on the resistances of the resistors 59 and 60, a drastic increase in the transfer current amount, which may occur upon abrupt switching from the constant-current control to the current voltage control, does not occur. Accordingly, fluctuations in the surface voltage of the photosensitive drum 27 and damage to the photosensitive layer are effectively prevented. Further, an adequate transfer bias can be applied to the transfer roller 30 without detecting the ambient temperature and humidity and controlling the transfer bias based on the detected ambient temperature and humidity. Accordingly, the laser printer 1 can be simplified in structure and the manufacturing cost thereof may be reduced.

When the toner is transferred to the narrow sheet 3, the area where the photosensitive drum 27 makes direct contact with the transfer roller 30 increases and a shortage of the transfer current to the sheet 3 tends to occur. In this embodiment, however, the toner can be properly transferred to the narrow sheet 3.

Figure 5:
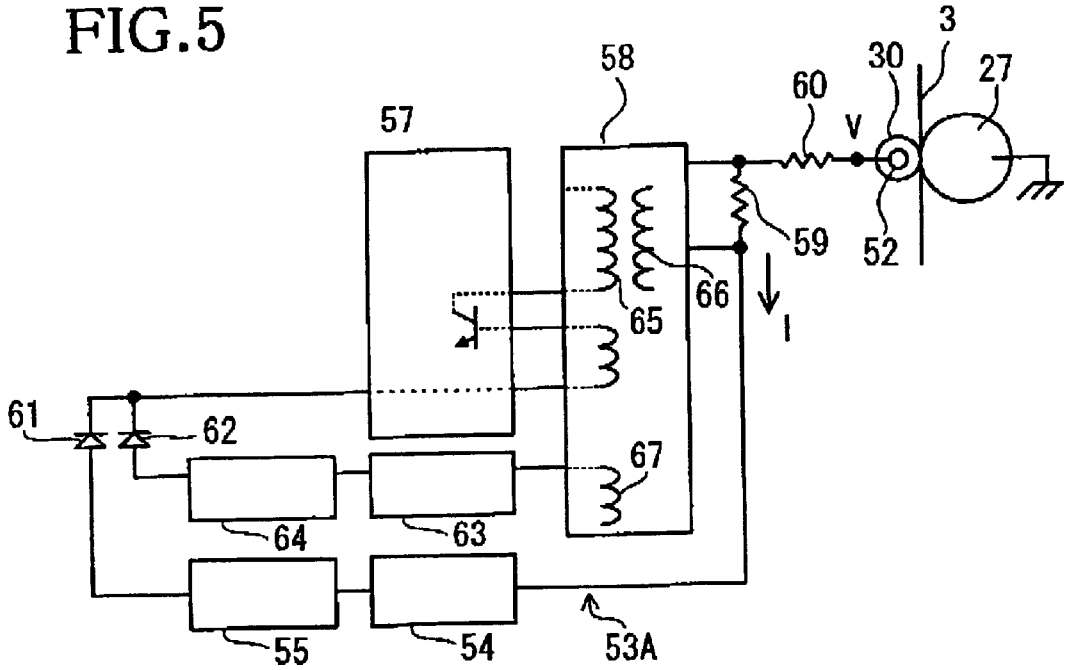
FIG. 5 is a diagram of a transfer bias application circuit different from the circuit of FIG. 3.

Instead of the constant-voltage source 56, an output voltage detection circuit 63 and a constant-voltage control circuit 64 can be provided, as shown in FIG. 5. More specifically, in a transfer bias application circuit 53A shown in FIG. 5, the constant-voltage control circuit 64 is provided instead of the constant-voltage source 56, and the output voltage detection circuit 63 is connected to the input of the constant-voltage control circuit 64. A detection wiring 67 is provided in the booster circuit 58 to detect the output voltage of the second wiring 66 and is connected to the output voltage detection circuit 63. Except for the above, the transfer bias application circuit 53A has the same structure as the circuit 53 shown in FIG. 3. The constant-voltage control circuit 64 controls the input voltage to the booster drive circuit 57 such that the voltage detected by the output voltage control circuit 63 is kept constant. The voltage detected by the output voltage control circuit 63 is proportional to the voltage outputted from the booster circuit 58, and thus the voltage outputted from the booster circuit 58 is also kept constant. When a sheet larger than a certain size is used in the laser printer 1 at room temperature, the resistances of the transfer roller 30 and the sheet 3 are high. In this case, the transfer bias application circuit 53A operates in the same manner as the transfer bias application circuit 53.

At this time, if the absolute value of the voltage of a transfer bias applied to the transfer roller 30 is low, the amount of transfer current decreases and the sheet 3 is insufficiently charged. As a result, the toner is not transferred from the photosensitive drum 27 to the sheet 3. Therefore, a sufficient amount of transfer bias current should be applied to the transfer roller 30 in order to improve the transfer efficiency of the toner to the sheet 3. The current value of the transfer bias (transfer current) applied to the transfer roller 30 is detected by the output current detection circuit 54. The constant-current control circuit 55 controls the booster drive circuit 50, based on the detected current value, such that a current outputted from the output of the booster circuit 58 is kept at a constant value. Such a constant current value should be a current value adequate for charging the sheet 3 and transferring the toner from the photosensitive drum 27 to the sheet 3.

An output from the booster circuit 58 can be changed by controlling an input to the booster drive circuit 57. The booster circuit 58 boosts an input to the booster circuit 58 between the primary and secondary windings 65, 66 and produces an output such that the current value detected by the constant-current detection circuit 54 becomes a predetermined value. Accordingly, the transfer bias kept at a constant current value is applied to the roller shaft 52 of the transfer roller 30 at all times.

Even if the resistances of the transfer roller 30 and the sheet 3 decrease when the laser printer 1 is used in a hot and humid environment, or when the type of sheet 3 is changed or the size of sheet 3 is reduced, the sheet 3 can be sufficiently charged by the constant-current control. However, if the resistance of the transfer roller 30 becomes lower than the resistance of the sheet 3, a current flows directly from the transfer roller 30 to the photosensitive drum 27 without passing through the sheet 3. Thus, the amount of current passing through the sheet 3 decreases and the sheet 3 is not sufficiently charged. As a result, the toner is not transferred from the photosensitive drum 27 to the sheet 3.

If the absolute value of the voltage of the roller shaft 52 (transfer voltage) falls below a certain value, the output voltage from the constant-voltage control circuit 64 exceeds the output voltage from the constant-current control circuit 55. The output of the constant-current control circuit 55 and the output of the constant-voltage control circuit 64 are connected to the input of the booster drive circuit 57, while the diode 61 is connected to the output of the constant-current control circuit 55 and the diode 62 is connected to the output of the constant-voltage control circuit 64. Thus, either the output voltage from the constant-current control circuit 55 or the output voltage from the constant-voltage control circuit 64, whichever is higher, is inputted to the booster drive circuit 57.

Therefore, when the output voltage from the constant-voltage control circuit 64 exceeds the output voltage from the constant-current control circuit 55, the booster drive circuit 57 controls the booster circuit 58 in response to the output voltage from the constant-voltage control circuit 64. Because the output voltage from the booster circuit 58 is kept constant, the relationship between the voltage and the transfer current applied to the roller shaft 52 is plotted as a linear function with a gradient being the resistance of the resistor 60. As the resistances of the transfer roller 30 and the sheet 3 decrease, the absolute value of the current value of the transfer bias increases and the absolute value of the voltage of the transfer bias (voltage of the roller shaft 52) decreases.

Figure 6:
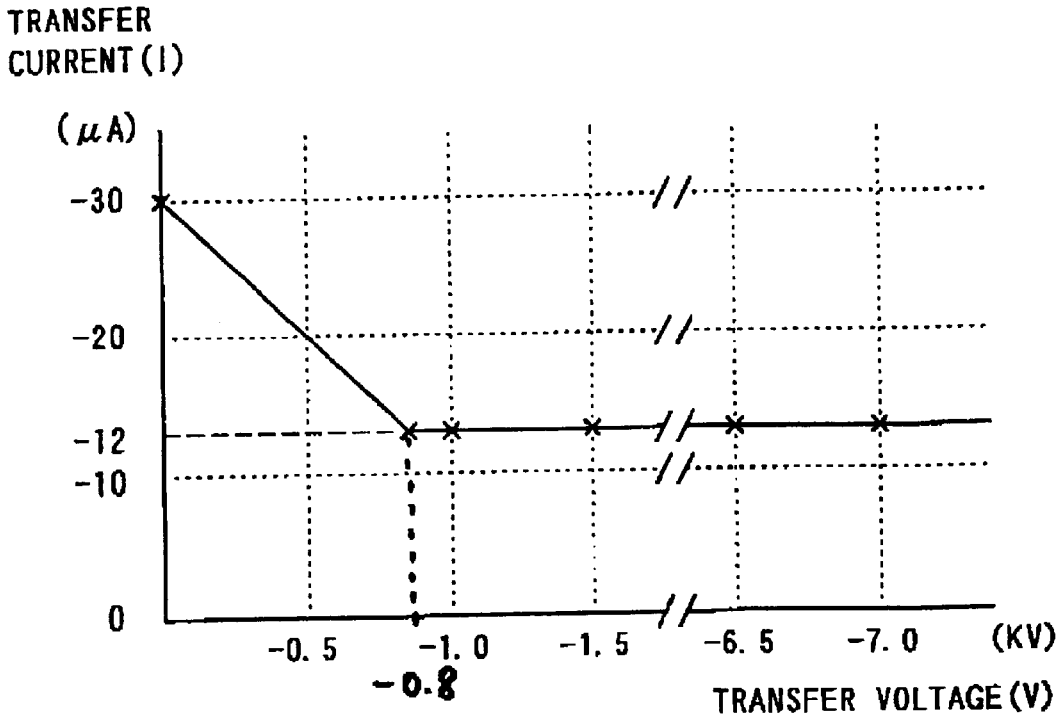
FIG. 6 is a graph showing the voltage-current relationship of a transfer bias applied by the transfer bias application circuit of FIG. 5.

FIG. 6 shows the voltage-current relationship of the transfer bias. The voltage of the transfer bias (transfer voltage in FIG. 6) indicates the voltage of the roller shaft 52 and changes with the resistances of the transfer roller 30 and the sheet 3 during the constant-current control. A current (transfer current in FIG. 6) of −12 $\mu$A is constantly supplied to the roller shaft 52. With this current value, a voltage difference great enough to transfer the toner to the sheet 3 is obtained between the sheet 3 and the photosensitive drum 27. Because the current value is constant, the absolute value of the voltage of the roller shaft 52 increases if the resistances of the transfer roller 30 and the sheet 3 are high.

If constant-current control to −12 $\mu$A is performed even after the resistances of the transfer roller 30 and the sheet 3 decrease, the absolute value of the voltage of the roller shaft 52 continues to decrease gradually. When the absolute value of the voltage of the roller shaft 52 decreases below approximately 800 V, the resistance of the transfer roller 30 is lower than the resistance of the sheet 3. In this case, the amount of the current passing through the sheet 3 decreases and thus the sheet 3 is not sufficiently charged. As a result, the toner transfer efficiency is reduced, causing deterioration of image quality.

The output voltage from the constant-voltage control circuit 64 is set such that the voltage of the roller shaft 52 (transfer voltage) becomes approximately −800 V and the transfer current becomes −12 $\mu$A when the booster drive circuit 57 is controlled based on the output voltage from the constant-voltage control circuit 64. When the absolute value of the transfer voltage decreases below 800 V, the output voltage from the constant-voltage control circuit 64 exceeds the output voltage from the constant-current control circuit 55. Thus, the output voltage from the constant-voltage control circuit 64 is inputted to the booster drive circuit 57. The constant-voltage control circuit 64 controls the booster drive circuit 57, based on the voltage detected by the output voltage detection circuit 63 via the detection wiring 67, such that the voltage outputted from the output of the booster circuit 58 (to the resistance 60) is kept constant.

The constant voltage outputted from the booster circuit 58 is applied to the roller shaft 52 via the resistor 60. As the resistances of the transfer roller 30 and the sheet 3 decrease, the absolute value of the transfer current increases and the absolute value of the voltage of the roller shaft 52 (transfer voltage) decreases linearly at a certain gradient.

In the transfer bias application circuit 53A shown in FIG. 5, when the ambient temperature is room temperature and the size of the sheet 3 substantially equals the width of the transfer roller 30, the resistances of the transfer roller 30 and the sheet 3 are high, and thus most of the transfer current passes through the sheet 3 and only a small amount of current leaks. Under such conditions, constant-current control is performed by the constant-current control circuit 55, as described above, in order to keep the transfer bias current applied to the transfer roller 30 at a required value for good toner transfer. In this embodiment, the transfer bias current is kept at $-12\ \mu A$. Accordingly, even if the resistances of the transfer roller 30 and the sheet 3 change with changes in temperature and humidity within a certain range and with changes in type and size of the sheet 3 within a certain range, a constant transfer current is supplied to the sheet 3 at all times to sufficiently charge the sheet 3. The toner on the surface of the photosensitive drum 27 can be transferred to the sheet 3 by the action of a Coulomb force. Particularly, because the resistance of the transfer roller 30 is variable with changes in temperature and humidity, the above-described constant-current control ensures sufficient charging of the sheet 3 and good toner transfer.

The resistances of the transfer roller 30 and the sheet 3 decrease under high temperature and high humidity conditions. If constant-current control is performed in this state, as described above, the absolute value of the voltage of the transfer bias decreases. When the size of the sheet 3 is reduced, the resistance of the sheet 3 decreases and the area where the photosensitive drum 27 makes direct contact with the transfer roller 30 increases. If constant-current control is performed in this state, the amount of current flowing to the portion of the transfer roller 30 out of contact with the sheet 3 relatively increases, while the amount of current passing through the sheet 3 relatively decreases. When the amount of current passing through the sheet 3 decreases, the sheet 3 is not sufficiently charged and a Coulomb force acting on the toner is reduced. As a result, the transfer efficiency is reduced, causing deterioration of image quality.

If constant-current control is performed when the total resistance including the resistance of the transfer roller 30 and that of the sheet 3 are low, the absolute value of the voltage of the roller shaft 52 (transfer voltage) decreases. According to one embodiment, when the absolute value decreases below 800 V, a constant voltage outputted from the constant-voltage control circuit 64 is inputted to the booster drive circuit 57. In this state, if the resistances of the transfer roller 30 and the sheet 3 further decrease, the absolute value of the transfer current linearly increases. Because the absolute value of the output voltage from the booster circuit 58 is constant, when the absolute value of the transfer current increases, the absolute value of the voltage of the roller shaft 52 (transfer voltage) decreases under the influence of a voltage drop by the resistor 60. Accordingly, the absolute value of the current passing through the sheet 3 increases. As a result, the transfer current is sufficiently supplied to charge the sheet 3, and the toner on the photosensitive drum 27 can be effectively transferred to the sheet 3.

In the transfer bias application circuit 53A shown in FIG. 5, the absolute value of the current value of the transfer bias, which is represented as a linear function, increases linearly. Thus, the required current can be obtained in a simply structured circuit, and the transfer bias required for good toner transfer can be applied to the transfer roller 30.

According to one embodiment of the laser printer 1, when a curve or a straight line representing the current value, shown in FIGS. 4 and 6, are shifted to a higher level in absolute value with respect to the vertical axis, electric discharge may occur between the transfer roller 30 and the photosensitive drum 27. On the contrary, when they are shifted to a lower level in absolute value, the toner deposited on the photosensitive drum 27 may remain there causing a ghost phenomenon. In this embodiment, the resistances of the resistors 59 and 60 are set such that the obtained curve or straight line representing the current value will not cause electric discharge or a ghost phenomenon.

In the transfer bias application circuit 53 shown in FIG. 3, when the resistances of the transfer roller 30 and the sheet 3 decrease with changes in size of sheet 3 and with changes in temperature and humidity, and the absolute value of the voltage of the roller shaft 52 of the transfer roller 30 decreases below the predetermined voltage, the control by the constant-current control circuit 55 is automatically switched to the control by the constant-voltage source 56. In addition, the diodes 61 and 62 prevent a current flow from the constant-current control circuit 55 to the constant-voltage source 56 and a current flow from the constant-voltage source 56 to the constant-current control circuit 55.

In the transfer bias application circuit 35A shown in FIG. 5, when the resistances of the transfer roller 30 and the sheet 3 decrease with changes in size of sheet 3 and with changes in temperature and humidity, and the absolute value of the voltage of the roller shaft 52 of the transfer roller 30 decreases below the predetermined voltage, the control by the constant-current control circuit 55 is automatically switched to the control by the constant-voltage control circuit 64. In addition, the diodes 61 and 68 prevent current flows from the constant-current control circuit 55 to the constant-voltage control circuit 64 and from the constant-voltage control circuit 64 to the constant-current control circuit 55. Accordingly, the transfer bias can be reliably controlled by a simply structured circuit, which contributes to cost reduction.

In the laser printer 1 according to one embodiment, the ionic conduction type transfer roller 30 is used. The ionic conduction type transfer roller 30 is advantageous in that its resistance is uniform and varies only slightly under constant environmental conditions, but disadvantageous in that its resistance varies greatly with changing environmental conditions such as temperature and humidity. An electronic conduction type transfer roller formed by covering a roller shaft with an elastic member containing conductive particles or filers may also be commonly used. An electronic conduction type transfer roller is disadvantageous in that its resistance varies greatly, but advantageous in that it is not susceptible to the environmental conditions such as temperature and humidity.

When the influence of the environmental factors such as temperature and humidity are considered, it is preferable to use an electronic conduction type transfer roller. However, the transfer current varies greatly place to place on the electronic conduction type transfer roller. However, when an ionic conduction type transfer roller is used, its resistance excessively decreases under high temperature and high humidity conditions and a shortage of transfer current to charge the sheet 3 tends to occur. In the laser printer 1 according to one embodiment, even when the resistance of the ionic conduction type transfer roller 30 decreases, the transfer current is increased to sufficiently charge the sheet 3. Accordingly, the toner is uniformly transferred to the sheet 3 and a high-quality image may be obtained.

During constant-current control, the transfer bias application circuit 53 applies the transfer bias to the roller shaft 52 of the transfer roller 30 such that the transfer current is kept at a constant current value. The transfer bias application circuit 53 may be structured such that the current value outputted during the constant-current control can be changed as required. More specifically, the current value can be changed by setting outputs from the constant-current control circuit 55 such that the absolute value of the constant current value becomes higher when the toner is transferred to a sheet 3 having a smaller contact area with respect to the transfer roller 30 (such as an envelope or a postcard), and becomes lower when the toner is transferred to a sheet 3 having a larger contact area with respect to the transfer roller 30 (such as B5-size or larger paper).

When an image is formed on a narrow sheet 3, a relatively large amount of current flows directly from the transfer roller 30 to the photosensitive drum 27 even under constant-current control, and a shortage of the transfer current to charge the sheet 3 may occur. In such a case, a sufficient amount of transfer current can be obtained by setting the absolute value of the constant current value of the transfer bias, at a higher level.

The method of changing the current value of the transfer bias applied during the constant-current control will be described. In one method of this invention, the current value of the transfer bias is changed by a printer driver of a personal computer connected to the laser printer 1 in response to the selection of the sheet size. The current value of the transfer bias is automatically changed when the user selects the sheet size by operating the printer driver.

In another method of this invention, a sheet size sensor is provided on the sheet conveying path to detect the size of the sheet 3, and the current value of the transfer bias applied during the constant-current control is automatically changed based on the detected size of the sheet 3. In this case, a table defining the relationship between the sheet size and the current value should be stored in a memory provided in the laser printer 1.

What is claimed is:

1. An image forming apparatus, comprising:

a photosensitive member on which a toner image is formed;

a transferring element that faces the photosensitive member and receives a bias;

a feeding mechanism that feeds a recording medium between the photosensitive member and the transferring element;

a biasing device that applies the bias to the transferring element;

a first controlling device that controls the biasing device such that a current value of the bias applied by the biasing device is kept constant; and a second controlling device that controls the biasing device such that the current value of the bias applied by the biasing device is changed, wherein the biasing device is controlled by one of the first controlling device and the second controlling device in response to an impedance imposed by the recording medium and the transferring element while the recording medium is between the photosensitive member and the transferring element.

2. The image forming apparatus according to claim 1, wherein the biasing device is connected to the first controlling device and the second controlling device and outputs the bias in response to either an output voltage from the first controlling device or an output voltage from the second controlling device.

3. The image forming apparatus according to claim 2, further comprising a first diode connected between the biasing device and the first controlling device, and a second diode connected between the biasing device and the second controlling device.

4. The image forming apparatus according to claim 2, wherein the biasing device outputs the bias in response to the highest output voltage from the first controlling device and the second controlling device.

5. The image forming apparatus according to claim 2, wherein the second controlling device is a constant-voltage source that outputs a constant voltage.

6. The image forming apparatus according to claim 2, wherein the second controlling device controls the output voltage from the second controlling device such that a voltage outputted from the biasing device is kept constant.

7. The image forming apparatus according to claim 1, wherein the transferring element is an ionic conduction type transfer roller.

8. The image forming apparatus according to claim 1, further comprising a third controlling device that controls the first controlling device to change a constant current value of the bias outputted from the biasing device.

9. The image forming apparatus according to claim 8, wherein the third controlling device controls the first controlling device to change the constant current value in response to a size of the recording medium fed by the feeding mechanism.

10. The image forming apparatus according to claim 9, wherein the third controlling device controls the first controlling device in a manner that an absolute value of the constant current value becomes higher as the size of the recording medium becomes larger.

11. A method for forming an image on a recording medium, comprising the steps of:

forming an image using toner on a photosensitive element;

feeding a recording medium between the photosensitive element and a transferring element;

applying a bias to a transferring element;

charging the recording medium with a current flowing by the bias through the recording medium; and transferring the toner to the recording medium by action of a voltage difference produced between the recording medium and the photosensitive element, wherein a current value of the bias is controlled by switching between a constant current value and a changing current value while the recording medium is between the photosensitive element and the transferring element.

12. The method of claim 11, wherein a constant current value is changed in response to a size of the recording medium fed.

13. The method o claim 12, wherein an absolute value of the constant current value becomes higher as the size of the recording medium becomes larger.

* * * * *